US007779893B2

(12) United States Patent
Leitch et al.

(10) Patent No.: US 7,779,893 B2
(45) Date of Patent: Aug. 24, 2010

(54) COMBINATION HEAT EXCHANGER HAVING AN IMPROVED END TANK ASSEMBLY

(75) Inventors: Frank Joseph Leitch, North Tonawanda, NY (US); Brian J. Coyle, Orchard Park, NY (US); Robert Charles Gmerek, Burt, NY (US)

(73) Assignee: Delphi Technologies, Inc., Troy, MI (US)

( * ) Notice: Subject to any disclaimer, the term of this patent is extended or adjusted under 35 U.S.C. 154(b) by 1037 days.

(21) Appl. No.: 11/507,804

(22) Filed: Aug. 22, 2006

(65) Prior Publication Data

US 2008/0047687 A1 Feb. 28, 2008

(51) Int. Cl.
*F28F 11/00* (2006.01)

(52) U.S. Cl. ..... 165/70; 165/148; 165/173; 165/175

(58) Field of Classification Search ..... 165/140, 165/174, 173, 176, 70, 148, 175, 150–153; 228/183

See application file for complete search history.

(56) References Cited

U.S. PATENT DOCUMENTS

| | | | | |
|---|---|---|---|---|
| 2,037,845 A | | 4/1936 | Young | 257/125 |
| 4,781,320 A | * | 11/1988 | Fujiyoshi | 228/183 |
| 4,817,967 A | * | 4/1989 | Belter | 277/598 |
| 4,926,934 A | * | 5/1990 | Ivy | 165/173 |
| 5,031,924 A | * | 7/1991 | Beatenbough et al. | 277/321 |
| 5,195,581 A | * | 3/1993 | Puntambekar et al. | 165/173 |
| 5,311,934 A | * | 5/1994 | Potier | 165/149 |
| 6,189,606 B1 | * | 2/2001 | Chevallier | 165/173 |
| 6,394,176 B1 | | 5/2002 | Marsais | 165/140 |
| 6,722,660 B2 | * | 4/2004 | Gernand et al. | 277/591 |
| 6,883,600 B2 | | 4/2005 | Mano et al. | 165/174 |
| 6,938,675 B2 | * | 9/2005 | Kokubunji et al. | 165/11.1 |
| 7,025,128 B2 | * | 4/2006 | Kamiyama et al. | 165/174 |
| 2006/0037740 A1 | * | 2/2006 | Durr et al. | 165/176 |

* cited by examiner

*Primary Examiner*—Terrell L McKinnon
(74) *Attorney, Agent, or Firm*—Patrick M. Griffin

(57) ABSTRACT

A combination heat exchanger comprising of a heat exchange core having a plurality tubes, wherein the core having at least one core end; an end tank having two side walls and two end walls, two bulkheads the cavity defining a least a first chamber, a second chamber, and a third chamber, a perimeter edge defined by exterior edges of said side walls, exterior edges of said two end walls, and exterior edges of said two bulkheads; a header plate engaged between said end tank and said core end; and a gasket between said perimeter edge and contact surface of said header plate, wherein the compression ratio of the gasket is varied along the contact surfaces of the perimeter edge and contact surface of the end plate.

15 Claims, 7 Drawing Sheets

Z
280
270
230
240
420
620
610
600
250
290
640
A
B

X
220b
220a
7
7
640
Y

COMBINATION HEAT EXCHANGER HAVING AN IMPROVED END TANK ASSEMBLY

TECHNICAL FIELD OF INVENTION

The invention relates to a combination heat exchanger, for a motor vehicle, having an end tank assembly that includes an integrated plastic tank mated to a metal header with an improved gasket therebetween; more particularly, where the improved gasket is formed of cure-in-place elastomer having varying compression ratios.

BACKGROUND OF INVENTION

Radiators are commonly used in automobiles having an internal combustion engine to convey heat away from hot engine components to the cooler ambient air. A radiator is part of a closed loop system wherein the radiator is hydraulically connected to passageways within an engine through which a heat transfer fluid, such as a mixture of water and ethylene glycol, is circulated.

A typical radiator is formed of a central core having a multitude of parallel tubes with fins therebetween to increase the surface area for optimal heat dissipation. Hydraulically attached to either end of the core that corresponds with the tube openings is an end tank. After absorbing heat from a heat source, the heat transfer fluid enters a first end tank where the fluid flow is uniformly distributed through the parallel tubes. As the fluid flows through the parallel tubes to the second end tank, heat is radiated to the ambient air. To assist in the heat transfer, a stream of ambient air is blown perpendicularly relative to the radiator core through the fins. The cooled heat transfer fluid then exits the second end tank returning to the heat source to repeat the heat transfer process.

Some motor vehicles have multiple radiators to cool a plurality of heat sources such as an internal combustion engine, transmission, electronic components, and charge air coolers. Typically, to meet the packaging requirements of a vehicle's engine compartment, the multiple radiators are stacked. A major draw back of stacking radiators is a decrease of heat transfer efficiency due to the increased pressure drop through the stack of radiators. There are other drawbacks of utilizing multiple radiators such as increase in vehicle weight, systems complexity, and manufacturing cost.

To address the shortcomings of using multiple radiators, it is known in the art to combine individual radiators utilizing a common core. Shown in FIG. 1 is a prior art combination radiator 1. The combination radiator includes a single core 10 assembled from multiple of parallel tubes 20. Longitudinally attached to either end of core 10 corresponding to the tube openings 35*a*, 35*b*, is an end tank 30*a*, 30*b*, respectively. Each end tank 30*a*, 30*b* has a transverse partition 40*a*, 40*b*, respectively partitioning the end tanks into compartments 50*a*, 50*b*, 60*a*, and 60*b*. Each of the end tanks is typically of metal construction with stamped openings 70 on a side wall 15 to accommodate the tubes openings 35. The tubes 20 are typically affixed to the side wall 15 of the end tanks by brazing or welding thereby effectively segregating the core 10 into a first core portion 80 and a second core portion 85.

For a combination radiator used to dissipate heat from two different heat sources in a vehicle, the first heat transfer fluid from the first heat source (not shown) enters the first inlet 90*a* to compartment 50*a*, travels through tubes 20 to compartment 50*b*, and then exits first outlet 90*b* returning to the first heat source. The second heat transfer fluid from the second heat source (not shown) enters the second inlet 95*a* to compartment 60*a*, travels through tubes 20 to compartment 60*b*, and exits second outlet 95*b* returning to the second heat source. The two heat transfer fluids are cooled by the same airflow which sweeps through core 10.

Utilizing a combination radiator to dissipate heat from multiple heat transfer fluids having different thermal and pressure cycle requirements may result in failure of structural integrity in transverse partitions 40*a*, 40*b*. The expansion differential between compartments 50*a*, 60*a* of an end tank 30*a* caused by the difference in temperature and pressure of the respective heat transfer fluids increases the stress on transverse partition 40*a*. Due to excessive stress, transverse partition 40*a* may fail thereby allowing the heat transfer fluids to intermingle resulting in potential damage to the heat sources being cooled. Furthermore, transverse partitions 40*a*, 40*b* does not offer a significant thermal barrier between the two different heat transfer fluids thereby resulting in decrease efficiency of heat dissipation of the cooler heat source.

For a combination radiator dissipating heat from heat transfer fluids with significantly different thermal and pressure cycle requirements, there is a need for a combination radiator with an end tank assembly with a robust separator that offers superior structural integrity and thermal isolation. There also exists a need that the end tank assembly can be manufactured easily and economically.

SUMMARY OF THE INVENTION

The invention relates to a combination heat exchanger, for a motor vehicle with an internal combustion engine, having an end tank assembly that includes a single piece integrated plastic tank mated to a metal header with an improved gasket therebetween. More particularly, the improved gasket is formed of cure-in-place elastomer, preferably silicone, having varying compression ratios.

The combination heat exchanger includes a heat exchange core having a bundle of tubes that are substantially parallel. The tubes are joint together longitudinally with heat dissipating fins. The core has two core ends, where each of the core ends is attached to an end tank assembly.

The end tank assembly includes a one piece integrated plastic tank, wherein the tank has two side walls connected to a bottom wall along a longitudinal axis, and two end walls along a latitudinal axis defining an elongated cavity. The exterior edges of the side walls and end walls define a perimeter edge. Within the elongated cavity are two bulkheads situated along a latitudinal axis dividing the elongated cavity into a first chamber, a second chamber, and a third chamber. Reinforcing the two bulkheads is a rib buttressing the two bulkheads with the bottom wall.

Also part of the end tank assembly is a metal header plate, preferably aluminum, engaged between each of the end tanks and core ends. The header plate has stamped perforations to accommodate the tubes openings. The tubes are attached to the header plate by conventional means such as brazing or soldering. The header plate is then mated to the plastic tank by mechanical means with a gasket therebetween.

Located between the integrated plastic tank and header plate is an elastomer gasket, preferably silicone. The gasket is applied on the perimeter edge of the end tank and exterior edges of the bulk heads, and then cured-in-place before the end tank is mated to the header plate by mechanical means.

The header plate has a stage portion with latitudinal pockets to cooperate with the exterior edges of the bulkheads to define a first spatial distance with respect to the gasket therein. The header plate also has an annular planar surface to cooperate with the perimeter edge of the end tank to define a second spatial distance with respect to the gasket therein. The first spatial distance is less than the second spatial distance, thereby resulting in a greater compression ratio of the gasket located within the first spatial distance relative to the compression ratio of the gasket located within the second spatial distance. More specifically, the compression ratio of the gasket on the exterior edges of the bulkhead is greater than the compression ratio of the gasket on the perimeter edge of the end tank.

The greater compression ratio of the gasket between the exterior edges of the bulkheads and lateral pockets of the header plate allows for a more robust seal between chambers. Robust seals are required along bulkheads to withstand stresses resulting from expansion differential between chambers within an end tank of a combination heat exchanger that houses heat transfer fluids with different temperature and pressure cycle requirements.

The objects, features and advantages of the present invention will become apparent to those skilled in the art from analysis of the following written description, the accompanying drawings and claims.

BRIEF DESCRIPTION OF DRAWINGS

The accompanying drawings illustrate a prior art combination heat exchanger and preferred embodiments of the present invention that will be further described with reference to the following figures.

DETAILED DESCRIPTION OF INVENTION

In reference to FIGS. 2 through 8, end tank 150 is shown substantially rectangular in appearance. The present invention does not intend the substantially rectangular shape to be limiting, but can also encompass other elongated shapes with an open face along the longitudinal axis.

Figure 1:
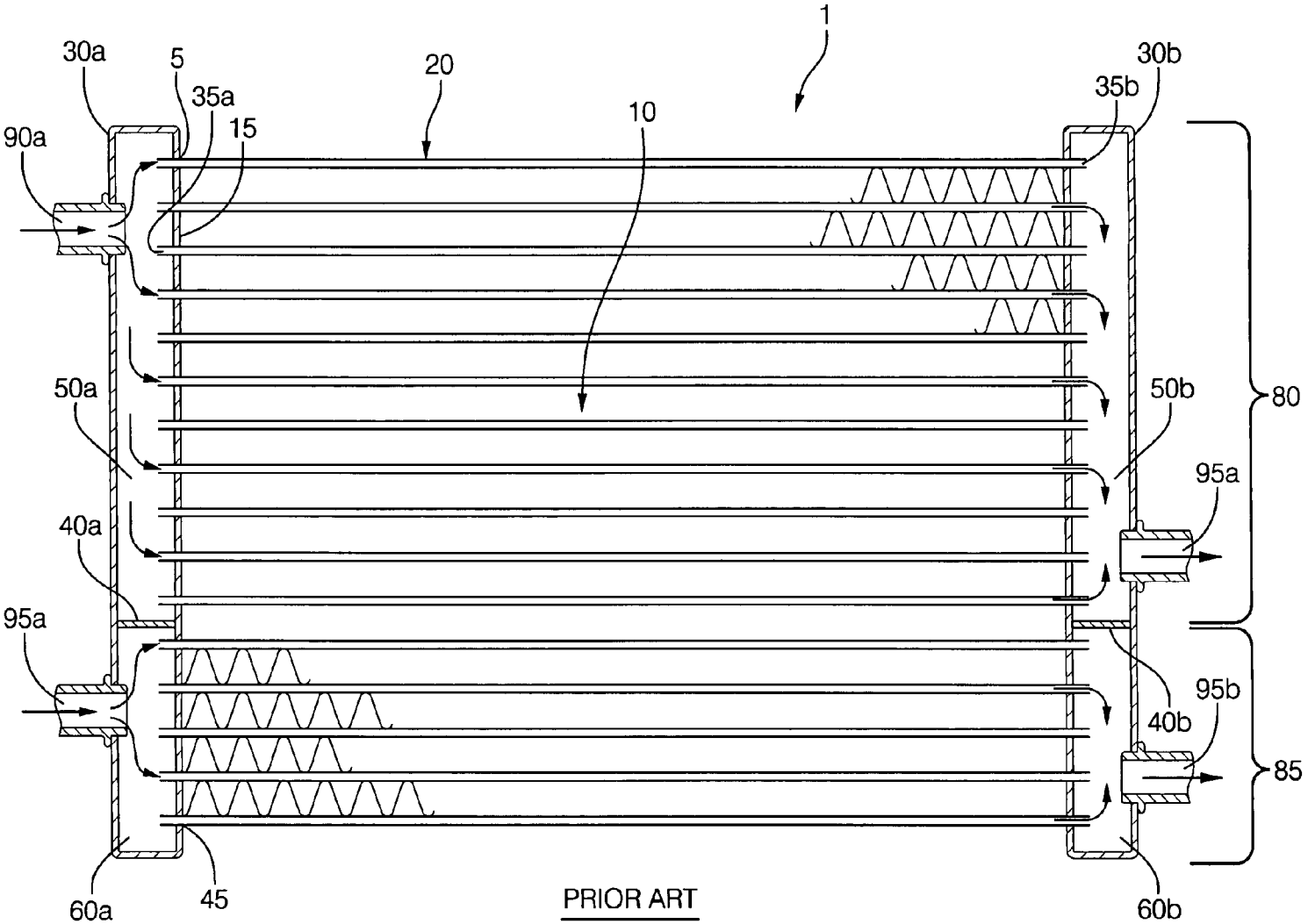
PRIOR ART FIG. 1
FIG. 1 is a cross-sectional view of a prior art combination heat exchanger.
Figure 2:
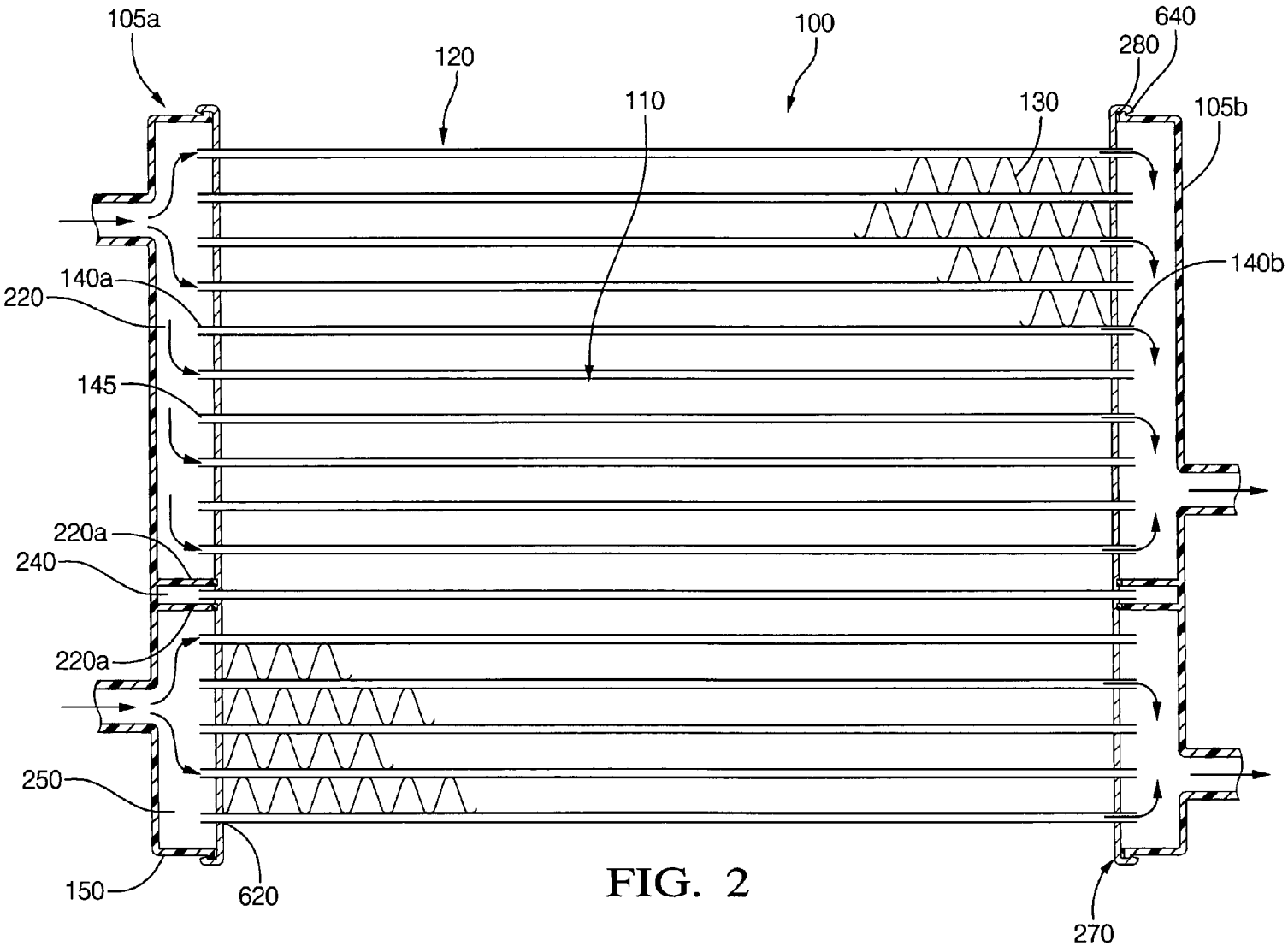
FIG. 2 is a cross-section view of the present invention combination heat exchanger having an end tank assembly that includes an integrated end tank, a header plate, and a gasket therebetween.

FIG. 2 is a cross-sectional view of the present invention combination heat exchanger. The heat exchanger includes a core 110 having a bundle of tubes 120 that are substantially parallel. The tubes 120 are jointed longitudinally by conventional means such as welding, brazing or soldering to a supporting structure such as fins between the tubes. The core 110 has two core ends 140*a*, 140*b* corresponding with tube openings 145.

Each core end is attached to end tank assembly 105 that comprises of end tank 150, a gasket 280, and a header plate 270. The tube openings 145 are affixed to perforations 620 located on the header plate 270 by conventional means such as welding, brazing or soldering. Header plate 270 is mechanically attached to end tank 150 with gasket 280 between the contact surfaces of header plate 270 and end tank 150.

Figure 3:
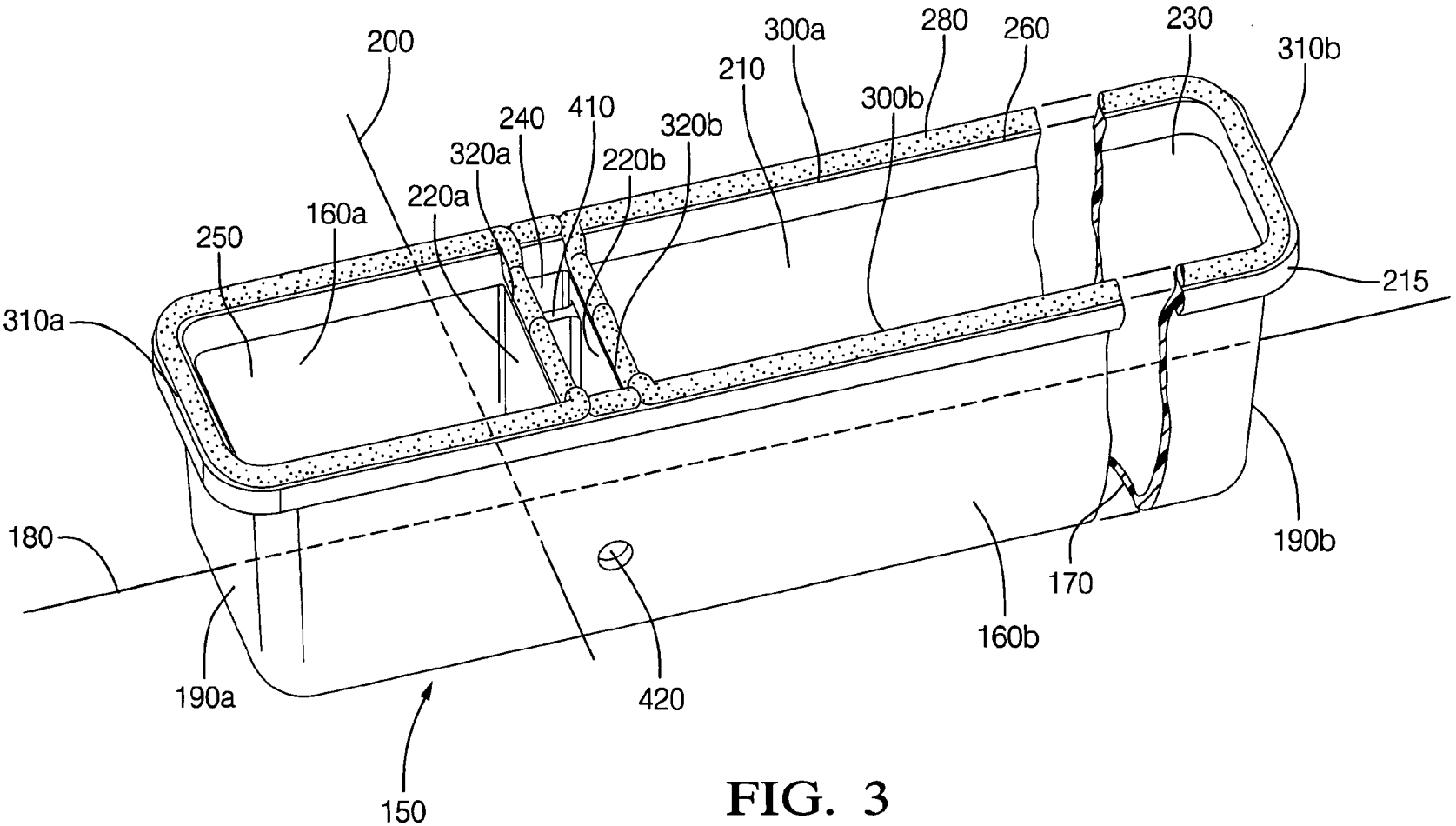
FIG. 3 is a perspective view of an integrated plastic end tank having two bulk heads, reinforcement rib, and means for leak detection with gasket applied on perimeter edge.

In reference to FIG. 3, end tank 150 has two side walls 160*a*, 160*b* that are integral with a bottom wall 170 along a longitudinal axis 180 and two end walls 190*a*, 190*b* along a latitudinal axis 200 defining an elongated cavity 210. The tank opening is defined by a perimeter tank foot 215 that protrudes laterally outward from the exterior edges of the two side walls 300*a*, 300*b* and exterior edges of the two end walls 310*a*, 310*b*.

Within the elongated cavity 210 are two bulkheads 220*a*, 220*b* situated along a latitudinal axis 200 dividing the elongated cavity 210 into a first chamber 230, a second chamber 240, and a third chamber 250. The heights of the bulkheads are less that heights of the side and end walls. Height of bulkhead is show as distance A and heights of walls are show as distance B in FIG. 5.

The volume distribution for each chamber, which is dictated by the number tubes 120 required to be in communication with each of the three chambers for the desired heat transfer requirements, can be adjusted by varying the placement of the bulkheads 220*a*, 220*b* along the longitudinal axis 180. The greater the temperature variation between first chamber 240 and third chamber 250, the greater the distance required between bulkheads for thermal isolation.

In reference to FIG. 3 through 8, the first chamber 230 and third chamber 250 are utilized for accumulation of heat transfer fluid and distribution of flow across the tubes 120. The second chamber 240 situated between the first chamber 230 and third chamber 250 is empty and acts as a thermal barrier to isolate the temperature and pressure variations between the first chamber 230 and third chamber 250. Tubes 120 in communication with the second chamber are dead, voided of fluid flow, thereby providing a thermal barrier between tubes in communication with first chamber 230 and tubes in communication with third chamber 250.

Reinforcing the two bulkheads is rib 410 integrally connecting bulkheads 220*a*, 220*b* with bottom wall 170. Rib 410 is located along the longitudinal axis 180 in the second chamber 240.

Also located within second chamber 240 is a mean to detect leaks from first chamber 230 and third chamber 250 into the second chamber 240. The means can include a mechanical or electrical sensing device; however, the preferred mean is an outlet 420 on a side walls between the bulkheads. A breach in integrity of either one of the bulkheads will result in heat transfer fluid filling second chamber 240 and then discharging through outlet 420. The direct discharge of the heat transfer fluid from either one of the bulkheads prevents intermingling of heat exchanger fluids and allows for economical leak detection since no additional hardware is required.

End tank 150 having bulkheads 220*a*, 220*b*, rib 410, and outlet 420 is formed of plastic, preferably nylon, and it is a seamless integrated one piece unit. End tank 150 can be manufactured by conventional means such plastic injection molding.

Figure 4:
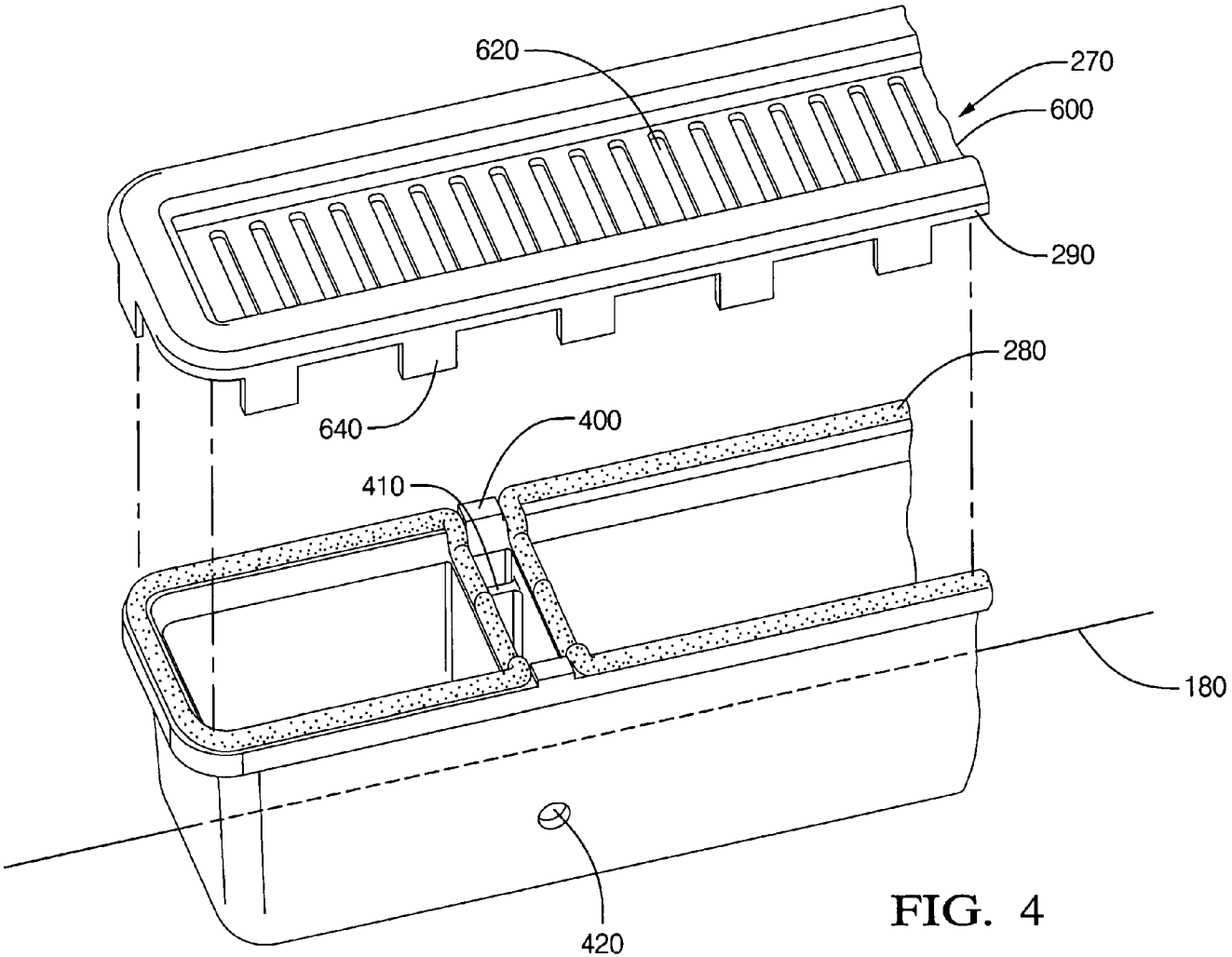
FIG. 4 is a partial perspective view of an alternative embodiment of an integrated plastic end tank having a foot step with gasket applied on perimeter edge in relationship to a metal header prior to assembly.
Figure 8:
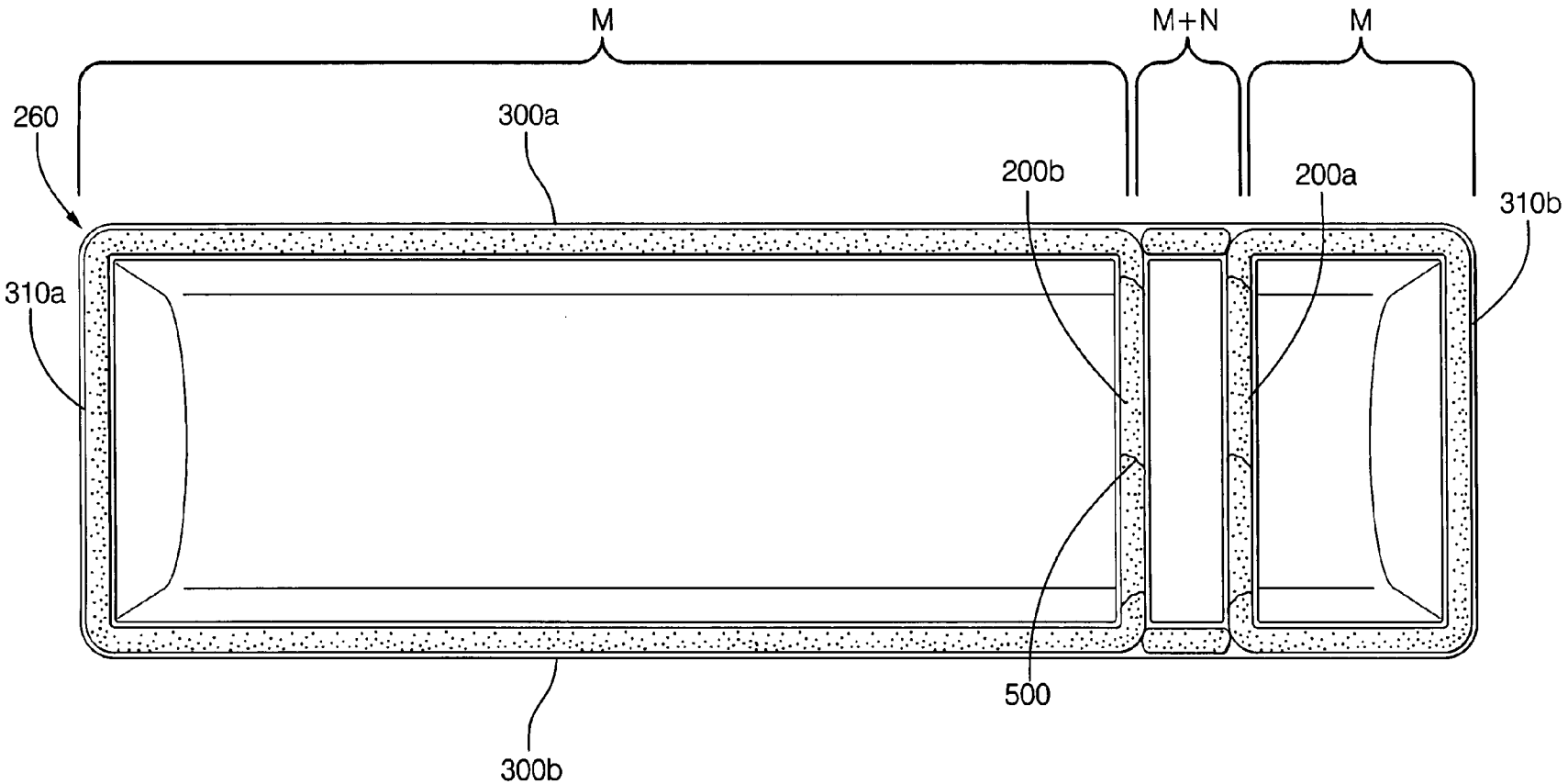
FIG. 8 is a top view of an integrated plastic tank with gasket applied showing difference in gasket compression ratio along perimeter edge.

In reference to FIGS. 3, 4, and 8, the exterior edges of the two side walls 300*a*, 300*b*, and exterior edges of the two end walls 210*a*, 210*b*, together with the protruding perimeter foot 500 forms a perimeter edge. A uniform bead of elastomer gasket 280 is applied on perimeter edge 260 and exterior edges of the two bulkheads 320*a*, 320*b*. The gasket is then cured-in-place prior to assembling end tank 150 to header plate 270.

In reference to FIG. 3, a bead of elastomer gasket is applied on the perimeter edge portion that outlines the first chamber 230 with the gasket knit line 500 overlapping on exterior edge of bulk head 320*b* defining first chamber 230. Another uniform bead of gasket is applied on the perimeter edge portion that outlines the third chamber with the gasket knit line 500 overlapping on exterior edge of bulk head 320*a* defining the third chamber 250.

It is desirable for the knit lines 500 of the gaskets to overlap on the exterior edges of the bulkheads 320*a*, 320*b*. The overlapping of the knit lines 500 provides additional gasket material to allow for greater compression ratio of the gasket on the edges of the bulk heads 320*a*, 320*b*. The higher compression ratio of the gasket provides greater seal integrity between the bulkheads with the header plate 270. It is optional to provide gasket on the portion of the perimeter edge that is part of the side wall of the second chamber located between the bulk heads.

The Compression Ratio of the gasket is defined as the ratio between the Compression Squeeze and the original cross-section of the gasket. The compression ratio is typically expressed as a percentage.

Compression Squeeze=original cross section−compressed cross section

Compression Ration (%)=(compression squeeze/original cross section)×100

Reference to FIG. 4 through 7, the physical feature of the header plate 270 includes a stage portion 600 that is elevated toward elongated cavity 210 of end tank 150. Stage portion 600 includes latitudinal pockets 610 to cooperate with the exterior edges of the bulkheads 320*a*, 320*b* to define a first spatial distance X shown in FIG. 6. The header plate also has an annular planar surface that circumscribes stage portion 600, to cooperate with the perimeter edge of the end tank to define a second spatial distance Y shown in FIG. 6. The original cross section or diameter of the gasket is shown as distance Z in FIG. 5 which is greater than distance Y and distance X.

Figure 7:
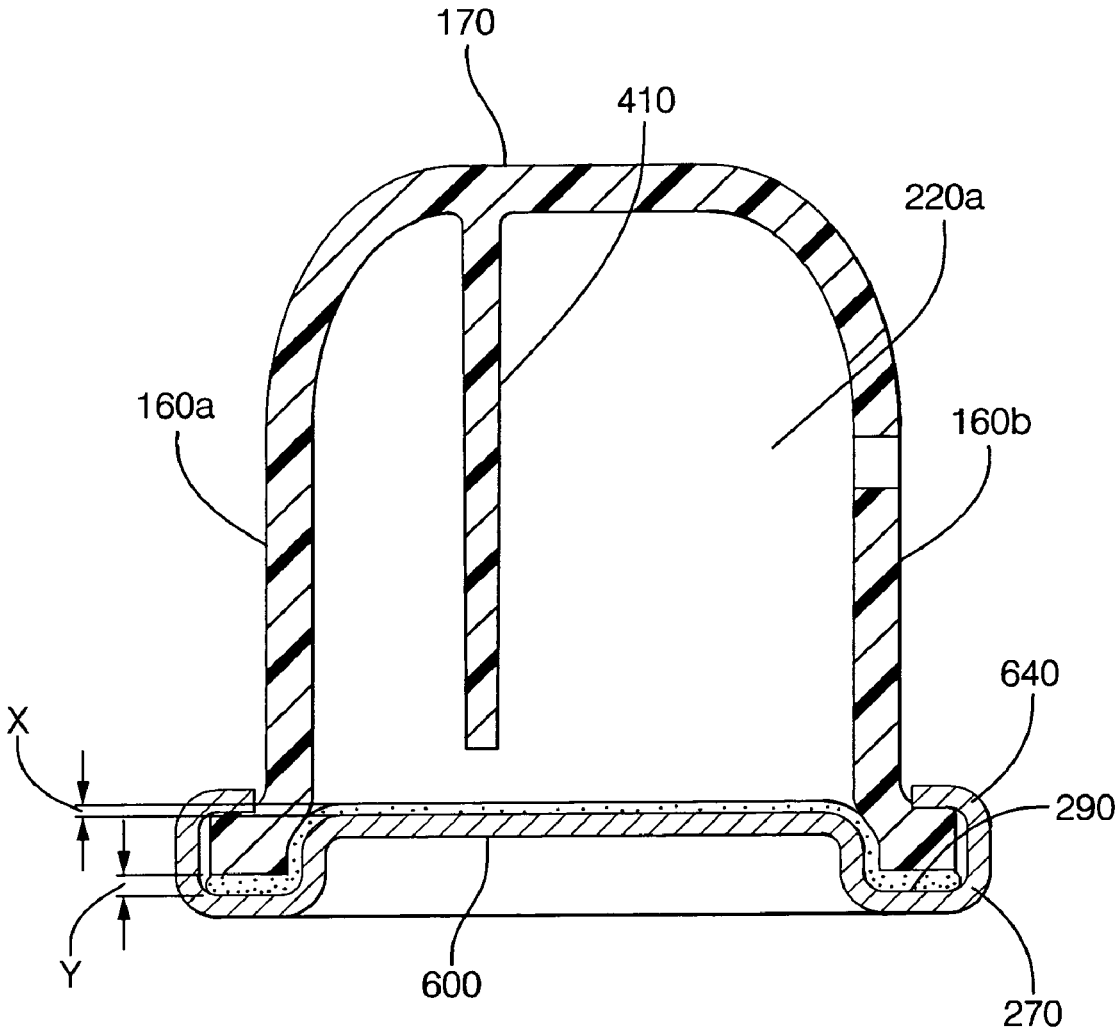
FIG. 7 is a cross sectional view of an integrated plastic end tank along latitudinal axis between bulkheads in relationship to a metal header after assembly.

The first spatial distance X is less than the second spatial distance Y, thereby resulting in a greater compression ratio of the gasket located within the first spatial distance relative to the compression ratio of the gasket located within the second spatial distance. More specifically, the compression ratio of the gasket on the exterior edges of the bulkhead is greater than the compression ratio of the gasket on the perimeter edge of the end tank as shown in FIG. 7.

The greater compression ratio of the gasket between the exterior edges of the bulkheads and lateral pockets of the header plate allows for a more robust seal between chambers. Robust seals are required along bulkheads to withstand expansion differential stresses associated with combination heat exchanger that houses heat transfer fluids with different temperature and pressure cycle requirements.

Figure 5:
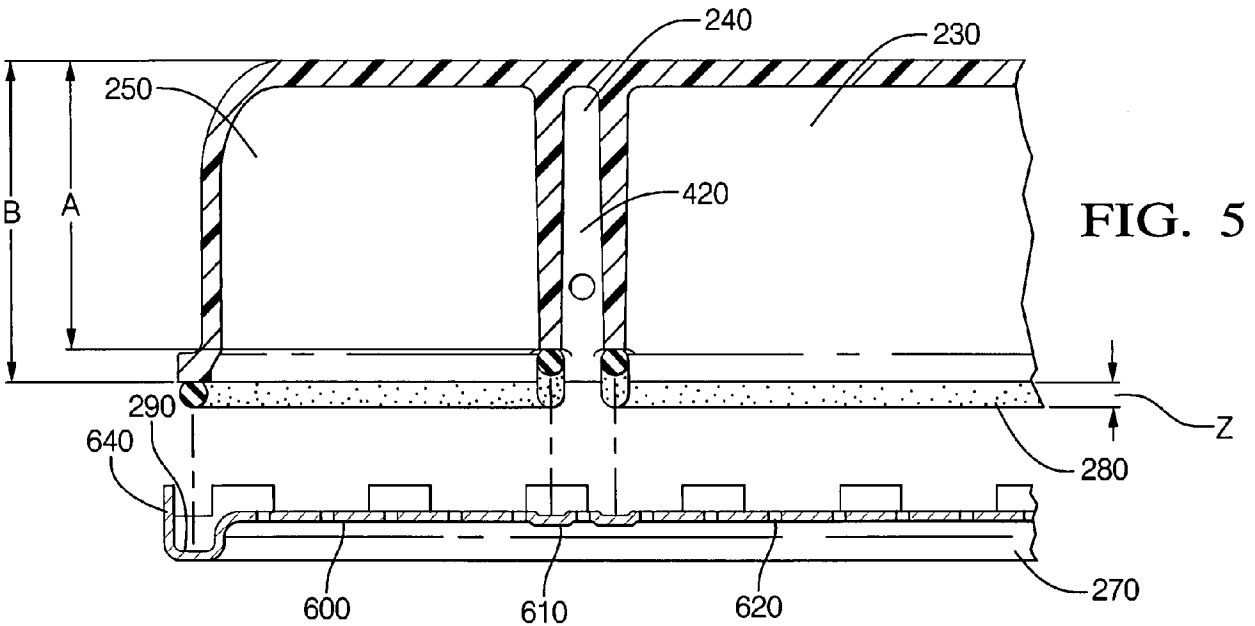
FIG. 5 is a partial cross sectional view taken along the longitudinal axis of an integrated plastic end tank with gasket applied on perimeter edge in relationship to a metal header prior to assembly.
Figure 6:
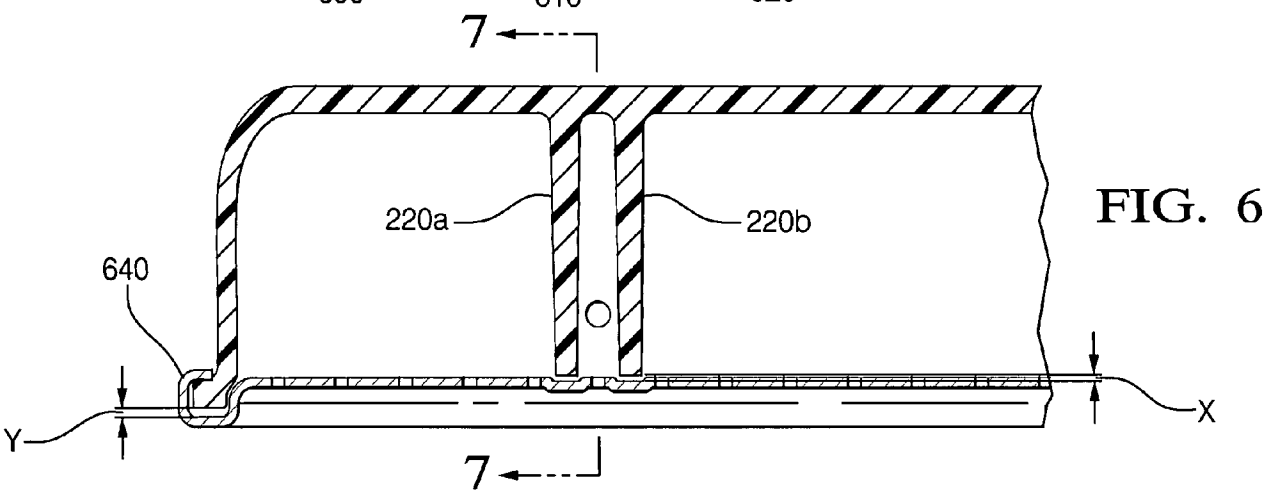
FIG. 6 is a partial cross sectional view taken along the longitudinal axis of an integrated plastic end tank with gasket in relationship to a metal header after assembly.

Referring to FIG. 4 through 6, periodically protruding outward of header plate 270 are crimp tabs 640. As header plate 270 is mated to the end tank 150, crimp taps 640 are plastically deformed to embrace the perimeter tank foot 215 of end tank 150. The latitudinal pockets 610 and annular planar surface 630 acts as the contact surface to the cure-in-place gasket which is applied on the perimeter edge of the end tank and exterior edge of bulkheads 220*a*, 220*b*.

Shown in FIG. 4 is another embodiment of the invention wherein a tank foot step 400 is located on the edges of the two side wall located between the bulkheads 220*a*, 220*b* in surrogate of a segment of gasket. The tank foot step 400 provides a secure seal against the contact surface of the header plate 290 while maintaining proper compression ratio of the gasket located along the exterior edges of the bulkheads 320*a*, 320*b*.

Referring to FIGS. 6 through 7. It is desirable for the compression of the gasket to be greater along the exterior edges of bulkheads 320*a*, 320*b*, shown as distance X, than that of the compression of the gasket along the remaining perimeter edge of the end tank 260, shown as distance Y.

Referring to FIG. 8, the compression ratio of the gasket along said exterior edges of said two side wall and along said exterior edges of said two end walls is represented as M %, where as the compression ratio of the gasket along exterior edges of said bulkheads is represented as M %+N %. The compression ratio of the gasket along said exterior edges of said two side wall and along said exterior edges of said two end walls is between 40 to 60 percent, preferably 50 percent, and the compression ratio of the gasket along exterior edges of said bulkheads is between 50 and 70 percent, preferably 60 percent.

The compression ratio of the gasket along the exterior edges of the bulkheads is determined by the spatial distance between the bulkheads and the latitudinal pockets of the header plate, shown as distance X in FIG. 6 and FIG. 7. The compression ratio of the gasket along the exterior edges of the perimeter edge is determined by the spatial distance between the perimeter edge and annular planar surface of the header plate, shown as distance Y in FIG. 6 and FIG. 7.

While this invention has been described in terms of the preferred embodiments thereof, it is not intended to be so limited, but rather only to the extent set forth in the claims that follow.

We claim:

1. A combination heat exchanger comprising of:

a heat exchange core having a plurality of tubes, wherein said core has at least one core end;

at least one end tank having:

two side walls along a longitudinal axis, and two end walls along a latitudinal axis defining an elongated cavity, two bulkheads along said latitudinal axis within said cavity defining a first chamber, a second chamber, and a third chamber, wherein said bulkheads have a height less than height of said two side walls and said two end walls; and a perimeter edge defined by exterior edges of said two side walls and exterior edges of said two end walls;

a gasket having an initial diameter, wherein said gasket is fixed on said perimeter edge and exterior edges of said bulkheads; and a header plate mechanically engaged with said end tank compressing said gasket therebetween, wherein said header plate has:

a stage portion elevated toward said cavity, said stage portion having latitudinal pockets cooperating with said exterior edges of said bulkheads defining a first spatial distance therebetween; and an annular planar surface cooperating with said perimeter edge defining a second spatial distance therebetween;

wherein end tank further comprises at least one foot step extending from a segment of said perimeter edge between said bulkheads in surrogate of a segment of said gasket, wherein said foot step engages a portion of said annular planar surface of header plate providing and maintaining said first spatial distance to be less than said second spatial distance; thereby ensuring a greater compression ratio of said gasket within said first spatial distance as compared to the compression ratio of said gasket within said second spatial distance.

2. A combination fluid heat exchanger of claim 1 wherein said first spatial distance is between 30 to 50 percent of said initial diameter of said gasket and the second spatial distance is 40 to 60 percent of said initial diameter of said gasket.

3. A combination fluid heat exchanger of claim 1 wherein said first spatial distance is between 40 percent of said initial diameter of said gasket and the second spatial distance is 50 percent of said initial diameter of said gasket.

4. A combination fluid heat exchanger of claim 1 wherein said gasket comprising a continuous bead of cure-in-place elastomer.

5. A combination fluid heat exchanger of claim 4 wherein said cure-in-place elastomer comprises silicone.

6. A combination fluid heat exchanger of claim 5 having knit lines of said cure-in-place elastomer located on said exterior edges of said bulkheads.

7. A combination heat exchanger of claim 1 wherein said tank further comprising:

at least one rib along said longitudinal axis between said bulkheads buttressing said bulkheads; and means to detect hydraulic leak though said bulkheads.

8. A combination fluid heat exchanger of claim 7 wherein said end tank, said bulkheads, said rib, and said means to detect hydraulic leak though said bulkheads are formed as a single plastic unit.

9. A combination fluid heat exchanger of claim 7 wherein means to detect hydraulic leak though bulkheads comprise of at least one outlet located on at least one of said two side walls of said second chamber.

10. An end tank assembly for as automotive heat exchanger of claim 1 wherein said gasket comprises of two linear beads of elastomer material where:

the first bead is applied on a first perimeter edge defined by exterior edges of said first end wall, first bulkhead, and portion of said two side walls therebetween, wherein the overlap line of bead is on center of exterior edge of said first bulkhead, the second bead is applied on a second perimeter edge defined by exterior edges of said second end wall, second bulkhead, and portion of two side walls therebetween wherein the overlap line of bead is on center edge of said one bulkhead.

11. An end tank assembly for an automotive heat exchanger of claim 10 wherein said first spatial distance is between 30 to 50 percent of said initial diameter of said gasket and the second spatial distance is 40 to 60 percent of said initial diameter of said gasket.

12. An end tank assembly for as automotive heat exchanger of claim 10 wherein said first spatial distance is between 40 percent of said initial diameter of said gasket and the second spatial distance is 50 percent of said initial diameter of said gasket.

13. An end tank assembly for a combination heat exchanger, comprising:

an end tank extending along a longitudinal axis having two bulkheads extending perpendicular to said longitudinal axis, wherein said end tank includes an open face having a perimeter edge, a foot step extending from a segment of said perimeter edge between said bulk heads, and an exterior edge along each of said bulk heads;

a header plate having a stage portion and an annular planar surface oriented toward said open face of end tank, wherein said foot step engages a portion of said annular planar surface and spaces header plate apart from said end tank at a predetermined distance, thereby defining a first spatial distance between said exterior edge of bulk head and stage portion of header plate and a second spatial distance between said perimeter edge of tank and said annular planar surface of header plate, wherein said first spatial distance is less than said second spatial distance a gasket having an initial diameter compressed within said first and second spatial distances, wherein said first and second spatial distances provide a first and second compression ratios for said gasket, respectively, and wherein said first compression ratio is greater than said second compression ratio.

14. The end tank assembly of claim 13, wherein said gasket comprising a continuous bead of cure-in-place elastomer.

15. The end tank assembly of claim 14, wherein said continuous bead of cure-in-place elastomer includes knit lines located on said exterior edges of said bulkheads.

* * * * *